US010065340B2

(12) United States Patent
Moyal

(10) Patent No.: US 10,065,340 B2
(45) Date of Patent: Sep. 4, 2018

(54) DEVICE AND METHOD FOR CLEAVING

(71) Applicant: LatticeGear, LLC, Beaverton, OR (US)

(72) Inventor: Gal Moyal, Los Gatos, CA (US)

(73) Assignee: LatticeGear, LLC, Beaverton, OR (US)

( * ) Notice: Subject to any disclaimer, the term of this patent is extended or adjusted under 35 U.S.C. 154(b) by 0 days.

(21) Appl. No.: 15/339,923

(22) Filed: Oct. 31, 2016

(65) Prior Publication Data

US 2017/0087744 A1 Mar. 30, 2017

Related U.S. Application Data

(63) Continuation-in-part of application No. 13/664,125, filed on Oct. 30, 2012.

(Continued)

(51) Int. Cl.
*B28D 5/00* (2006.01)
*B26F 3/00* (2006.01)

(Continued)

(52) U.S. Cl.
CPC ..... *B28D 5/0011* (2013.01); *B26D 5/007* (2013.01); *B26F 3/002* (2013.01); *B28D 1/225* (2013.01);

(Continued)

(58) Field of Classification Search
CPC ..... B28D 5/00; B28D 5/0011; B28D 5/0023; B28D 5/0041; Y10T 225/12;

(Continued)

(56) References Cited

U.S. PATENT DOCUMENTS 3,998,201 A * 12/1976 Miura ..... B28D 1/00 100/231
4,790,465 A * 12/1988 Fellows ..... G02B 6/25 125/23.01

(Continued)

FOREIGN PATENT DOCUMENTS

EA 0334751 9/1989
WO 93/04497 3/1993

OTHER PUBLICATIONS

Figueroa, Victor "Designing a Mechanism to Cleave Silicon Wafers," MIT Sep. 2004.

*Primary Examiner* — Jason Daniel Prone
*Assistant Examiner* — Richard Crosby, Jr.
(74) *Attorney, Agent, or Firm* — Ater Wynne LLP

(57) ABSTRACT

A device and method for cleaving a sample includes: creating an indentation on a top surface of the sample by applying a downward force along a vertical axis, the axis arranging perpendicularly to the top surface of the sample; providing a breaking pin and arranging the breaking pin under the sample to touch the bottom surface of the sample at a position that is directly opposite from the indentation; and, applying a downward force on the sample by providing a left side and right side breaker pin wherein the downward force comprises a left-side downward force extended through the left-side breaker pin and right-side downward force through the right side breaker pin, further the pins that provide the left-side and right-side downward force are disposed on a breaker bar and arranged to be on opposite sides of a vertical axis that extends through the indentation on the top surface.

12 Claims, 27 Drawing Sheets

Related U.S. Application Data

(60) Provisional application No. 61/558,122, filed on Nov. 10, 2011.

(51) Int. Cl.
*B26D 5/00* (2006.01)
*B28D 1/22* (2006.01)
*B28D 7/02* (2006.01)

(52) U.S. Cl.
CPC ..... *B28D 5/0023* (2013.01); *B28D 5/0041* (2013.01); *B28D 5/0076* (2013.01); *B28D 7/02* (2013.01); *Y10T 83/0333* (2015.04); *Y10T 225/12* (2015.04); *Y10T 225/325* (2015.04); *Y10T 225/371* (2015.04)

(58) Field of Classification Search
CPC .... Y10T 225/321; Y10T 225/325; B26F 3/00; B26F 3/002; B26D 1/00; B26D 1/22; B26D 1/225; B26D 1/226
USPC ..... 225/96, 96.5
See application file for complete search history.

(56) References Cited

U.S. PATENT DOCUMENTS 4,995,539 A * 2/1991 Richard ..... B26F 3/002 225/103
5,016,800 A * 5/1991 Sato ..... B28D 5/0011 225/103
5,069,195 A * 12/1991 Barozzi ..... B28D 5/0023 125/23.01
5,740,953 A * 4/1998 Smith ..... B28D 5/0005 225/1
6,223,961 B1 * 5/2001 Boguslavsky ..... B28D 5/0023 225/103
6,577,804 B2 * 6/2003 Murakami ..... G02B 6/25 225/96
7,070,078 B2 * 7/2006 Song ..... B26D 1/18 225/105
9,272,941 B2 * 3/2016 Giron ..... C03B 33/0222
9,295,969 B2 * 3/2016 Okuma ..... B23K 26/0057
9,302,410 B2 * 4/2016 Shimoi ..... B23K 26/0057
9,908,255 B2 * 3/2018 Takaichi ..... H02K 15/03
2007/0158381 A1 * 7/2007 Lisec ..... C03B 33/033 225/2
2009/0230102 A1 * 9/2009 Soyama ..... B28D 1/221 219/121.69
2010/0011927 A1 * 1/2010 Lee ..... B26D 3/08 83/100
2010/0163593 A1 * 7/2010 Song ..... G02B 6/25 225/96
2011/0252935 A1 * 10/2011 Welsh ..... G01N 1/08 83/37
2013/0119106 A1 * 5/2013 Moyal ..... B28D 1/225 225/2
2014/0299645 A1 * 10/2014 Lurie ..... G02B 6/25 225/96
2016/0136835 A1 * 5/2016 Ohshima ..... H01F 41/0286 225/104
2017/0087744 A1 * 3/2017 Moyal ..... B28D 1/225

* cited by examiner

Detail B

DEVICE AND METHOD FOR CLEAVING

CROSS-REFERENCE TO RELATED APPLICATIONS

This is a continuation-in-part of application of U.S. patent application Ser. No. 13/664,125 filed on Oct. 30, 2012, which claims the benefit of U.S. Provisional Patent Application Ser. No. 61/558,122 filed on Nov. 10, 2011, the contents of which are hereby incorporated by reference.

TECHNICAL FIELD

This description relates generally to a method and device for breaking a plate-like substrate and more specifically to a method and device for cleaving a semi-brittle sheet such as a silicon or gallium arsenide, or sapphire, or similar material.

BACKGROUND

Currently, there are two approaches to cleaving monocrystalline materials and the like. The first approach a low-cost, low-sophistication option, which requires a highly skill-dependent procedure (based on experience and expertise and training), teaches manually aligning by human sight a substrate and using hand tools, such as scriber pens or rudimentary cleaving apparatus (described in more detail, below). And, a second approach, which is more high-cost hut less error-prone, teaches a mechanized approach that is capital intensive in both equipment cost and operator training and, as a result, are only acquired by the top 25 semiconductor manufacturers (worldwide). This later type of cleaving apparatus is not only complicated to make and use, but requires a much larger footprint and takes valuable space in the lab and has an ongoing high cost of operation.

Examples of these two approaches include, for example, at the low-tech, low-cost, highly human-variable end of the spectrum, an apparatus described by Richard in U.S. Pat. No. 4,995,539 issued on 1991 Feb. 26. Therein a method and apparatus for cleaving a semiconductor wafer or substrate includes scribing one of the substrate surfaces with at least one scribing line to define a plane where the substrate is to be broken; placing the substrate, with its scribed surface facing upwards, between an upper and a lower foil, both foils being elastomeric and extending beyond the margins of the substrate, an adhesive serving to join the substrate to the lower foil; stretching the two foils with the substrate sandwiched in-between; applying an upward force to the lower side of the sandwich structure so as to bend the substrate, the plane of the radius being normal to the scribed lines on the convex side of the substrate and to break the substrate into individual bars as determined by the scribed lines, thus enabling the part of the lower foil to which the substrate was initially joined and to which the bars still adhere to further stretch whereby the individual bars become separated sufficiently so as to avoid mutual damage of the neighboring broken off surfaces; and removing the upper foil so that the individual bars can be further processed. Further, Richard teaches an apparatus for breaking a plate-like substrate that includes a base element having an essentially plane upper surface, its longitudinal extension being larger than that in the transverse direction; a first gripper fixedly positioned in respect of the base element, provided and arranged for releasably holding one sandwich end; a second gripper movably arranged at the base element for movement in the longitudinal direction, provided and arranged for releasably holding the other sandwich end; apparatus for adjustably displacing the second gripper in the longitudinal direction from the first gripper; and a cylindrical rod adapted to be placed on the upper surface of the base element with its cylinder axis parallel to the transverse direction and to be movable in the longitudinal direction.

Another low-tech approach includes manually scribing a line on the back side of a substrate using a scribing knife, placing the wafer over a cleaving bar from the glass industry, and manually pushing down on the work piece using two pins.

Boguslavsky et al. in U.S. Pat. No. 6,223,961 issued on 2001 May 1 teach another apparatus for cleaving crystals consisting of a pair of aligning pins facing a first cleave plane formed on a first side of a substrate, an impact pin facing a second cleave plane formed on a second side of the substrate, the substrate having a pre-scored cleave line extending between and generally perpendicular to the opposing cleave planes, and an actuator connected to at least one of the aligning pins and the impact pin.

Cornu, in European Patent No. 03347 51 issued on 1989 Sep. 27 titled for resting a silicon wafer, a cleaving bar (similar to what is used in glass cutting) arranged under, the wafer, and a pair of push bars that are interconnected and hingeably mounted to selectively apply downward presser on the wafer. The break of the wafer occurs on a line that is aligned by use of a magnification optic on the device and corresponds to a pre-formed score in the wafer. An actuator pushes upward on a rear portion of the coupled push bars to cause the push bars to travel downward towards the wafer.

Examples of known systems and methods that require considerably more capital investment, higher training levels for the operators, and more complexity include the method and apparatus for cleaving semiconductor wafers described by Smith et al. in U.S. Pat. No. 5,740,953 issued on 1998 Apr. 21. Therein, Smith teaches a method wherein, on a first lateral face of the semiconductor wafer, laterally of the workface on one side of the target feature, an indentation in alignment with the target feature; and inducing by impact in a second lateral face of the semiconductor wafer, laterally of the workface on the opposite side of the target feature, a shock wave substantially in alignment with the target feature and the indentation on the first lateral face causes a split in the semiconductor wafer along a cleavage plane essentially coinciding with the target feature and the indentation. Smith further teaches an apparatus for implementing his method. Such an apparatus includes a microscope with two eyepieces and several objectives, a vacuum chuck assembly holding means, a gear assembly including an electric step motor, tracks, and gripper assemblies, for example.

The aforementioned known methods and apparati have shortcomings, alone or in combination, including the reliance on a pre-scribed cleave line in the silicon and significant human skill and or training to operate, are highly variable due to the human factor, or are very large and require high capital initial expenditure, involve high operating costs, complexity, and are overly precise for some operations. Thus, there remains a need for a cleaving device and method that is economical to produce, inexpensive to operate and maintain, require minimal training to operate, reduce the required skill or training to operate, yet provide a highly accurate, repeatable, and clean break of a silicon wafer and the like at a precisely prescribed location, along a particular desired line.

SUMMARY

The following presents a simplified summary of the disclosure in order to provide a basic understanding to the reader. This summary is not an extensive overview of the disclosure and it does not identify key/critical elements of the invention or delineate the scope of the invention. Its sole purpose is to present some concepts disclosed herein in a simplified form as a prelude to the more detailed description that is presented later.

The present example provides a low cost, high quality, high accuracy cleaving device and method suitable for mono-crystalline material and other brittle substrates. Further, the device and method of the present invention offers successful cleaving through a target even with minimal experience and expertise and doesn't rely on human capabilities, such as hand and eye coordination based on skill or extensive training.

Further, the present invention is well-adapted for use for site specific, cross-sectional examination, with accuracy of a few microns to the area of interest. The present invention works well with various samples including front-end, back-end, TSVs, and single die, for example. Another well-suited use includes a bulk removal step prior to FIB "focused ion beam". The present invention has accuracy on the order of one micron. The present invention can be used to reduce large substrate pieces to small samples suitable for further preparation in ion beam and electron beam instruments. Yet another use for the present invention includes quality analysis of wafers where a quality analysis of wafer sample cross-section is desired, for example. Another use for the present invention includes sample preparation for Failure Analysis and process monitoring and product development.

In one preferred embodiment, a device according to the present invention mechanizes and systemizes the most common, basic manual scribe and cleave process practiced daily in laboratories using paper clip and fingers. The device includes a stage for supporting a substrate, a diamond knife, termed herein as an "indenter" to 'dent' the area of interest from the top-side, this process is depicted in FIGS. 20-24.

Based on the size of the target and the application required, the device can be used with the naked eye, placed under optical microscope or couple up with magnification devices.

Other contemplated features of the present invention include: With camera kit, vertical mounting pole arranged perpendicular to table; Kits, pliers, scribes;

- Although not shown in the appended figures, an optical microscope could be bundled with the device to improve target and positioning accuracy;
- Another option not fully captured in the appended drawings includes the use of vacuum or CDA to create vacuum, which will improve the cleanliness and accuracy of the cleave. For example, compressed air is used to hold the sample on the stage, but also can be used to remove dust from the stage by manually using a nozzle to dust off the stage, and suction devices can be incorporated for aiding in the removal of the cut sample from the stage;
- The stage moves in the X direction, perpendicular to the plane of 34, 36 for positioning the target. It can move accurately in 0.5-sub-micron increments by moving knob 24, for example. Contemplated embodiments of the present invention include motion in the x-direction to position the sample on top of the two breaker pins.

The end device, in yet another contemplated embodiment, is placed under an Optical Microscope with long working distance optics. Another option would be to use a compact digital camera or other magnifying optics.

Many of the attendant features will be more readily appreciated as the same becomes better understood by reference to the following detailed description considered in connection with the accompanying drawings.

DESCRIPTION OF THE DRAWINGS

The present description will be better understood from the following detailed description read in light of the accompanying drawings, wherein.

Like reference numerals are used to designate like parts in the accompanying drawings.

DETAILED DESCRIPTION

Figure 1:
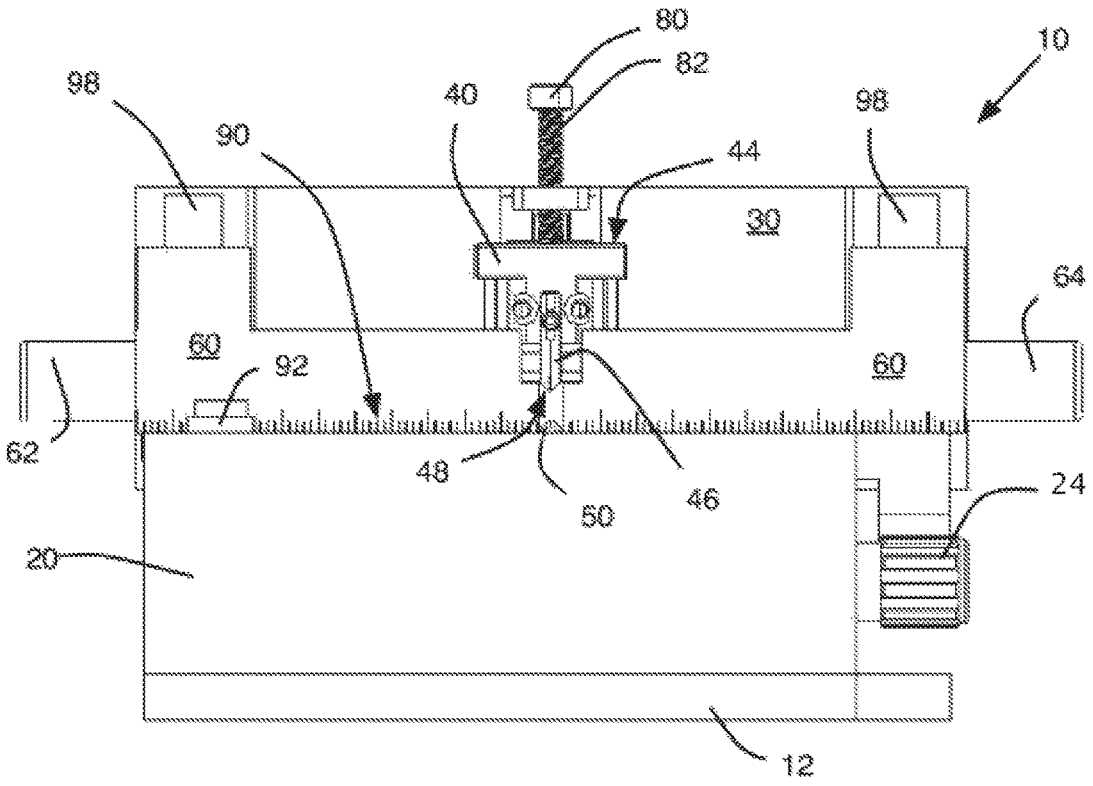
FIG. 1 is a front view of a first preferred embodiment of the present invention.
Figure 2:
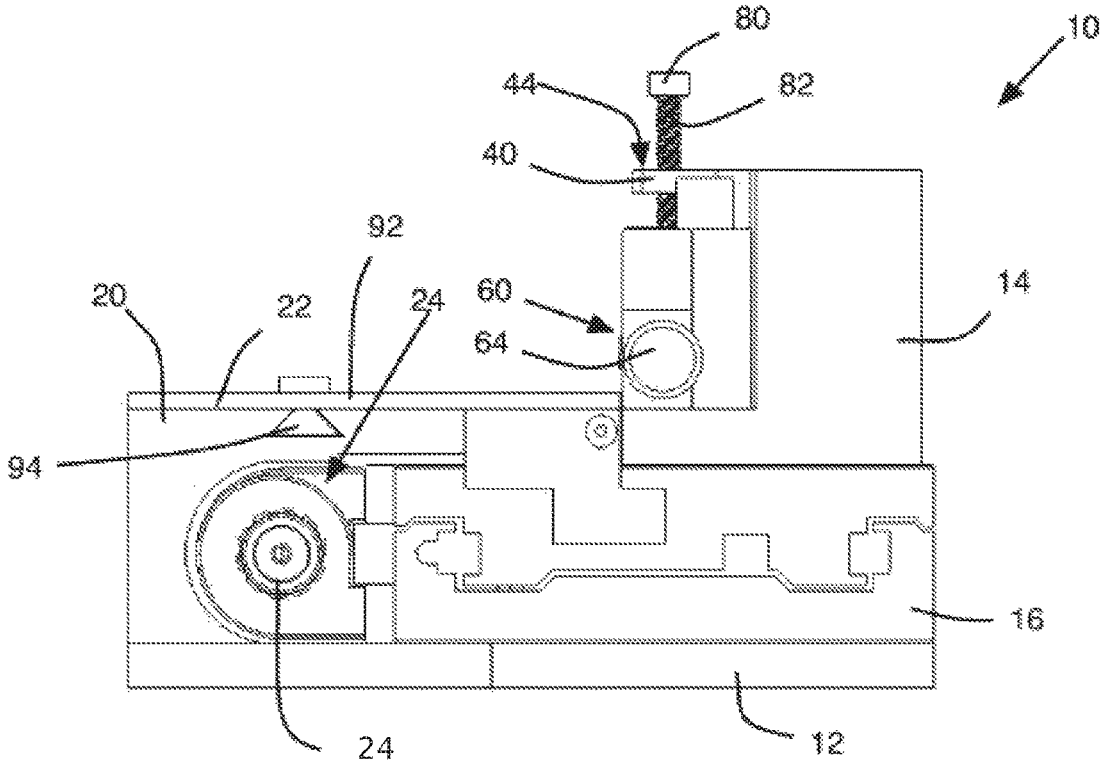
FIG. 2 is a side view of the embodiment of FIG. 1.
Figure 3:
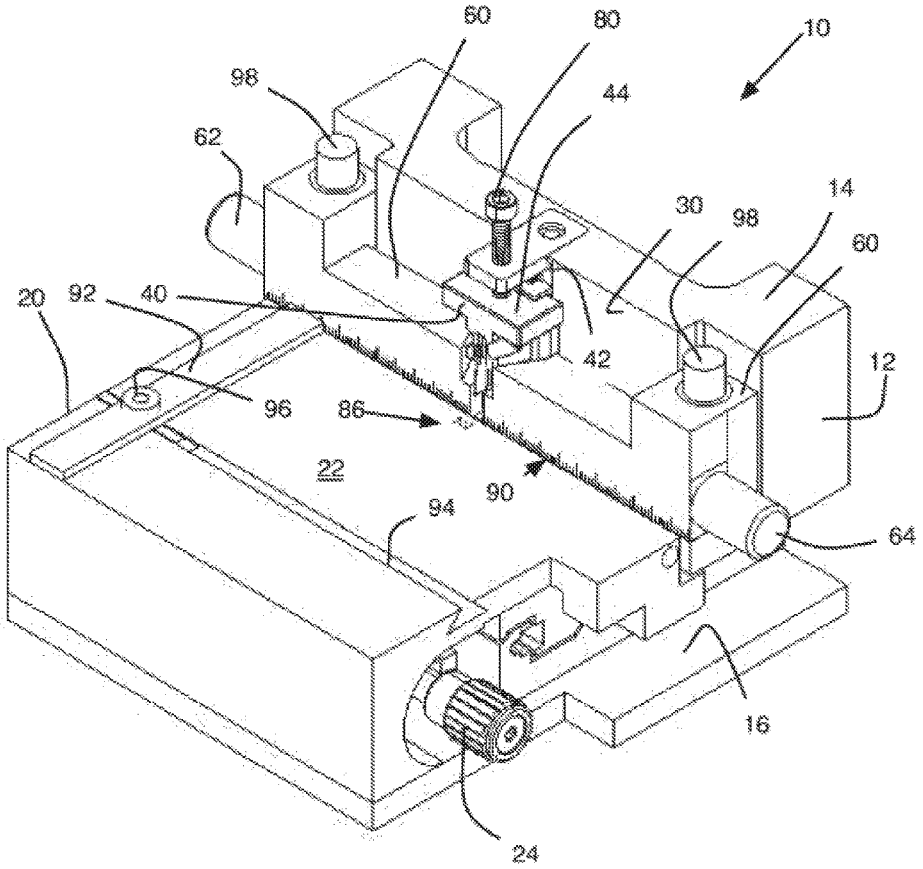
FIG. 3 is an offset frontal view of the embodiment of FIG. 1.

The detailed description provided below in connection with the appended drawings is intended as a description of the present examples and is not intended to represent the only forms in which the present example may be constructed or utilized. The description sets forth the functions of the example and the sequence of steps for constructing and operating the example. However, the same or equivalent functions and sequences may be accomplished by different examples.

The examples below describe a semiconductor wafer cleaving system. Although the present examples are described and illustrated herein as being implemented in a general wafer cleaving system, the system described is provided as an example and nota limitation. As those skilled in the art will appreciate, the present examples are suitable for application in a variety of different types of flat planar wafer cleaving systems.

In a first preferred embodiment, as FIGS. 1-3 and 18 show, the present invention contemplates a device for cleaving a substrate. The device 10 also includes a stage 20 disposed on the housing body 12, the stage having a substantially flat top 22 and a device (inside the stage 20 but shown exposed in FIGS. 26-27) for adjusting horizontally in the x-direction with sub-micron precision, coupled to a knob 24 rotatably coupled to the stage adjusting mechanism.

The device 10 further includes a lever 40 comprising a slide member slideably inserted in a track 42, the lever further including a handle 44 and a retraction spring, which is adapted to hold the slide at atop position in the first track and the handle member is operable to move the lever vertically downward, the lever further carrying a knife or indenter 46 in a tip holder, the knife or indenter having a diamond tip 48 at a lower, leading edge. Although a 90-degree dent is described here this "scribe" could be made at various angles between 45-135 (+/−45) degrees. A derivative of the current embodiment may be implemented with this angle adjustment to improve positioning accuracy and minimize the contact area between the sample and the diamond tip.

The device 10 also includes a breaking pin 50 mounted on the housing body 12 to arrange under the cleaving bar. The pin is centered to align with the vertical axis of the knife that creates the indentation on the sample—the knife indents the top surface of the sample, but the pin arranges to be adjacent to the bottom surface of the sample.

Figure 13:
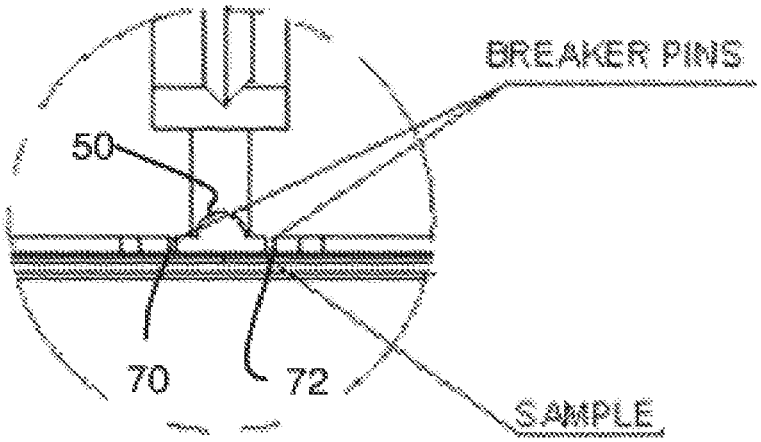
FIG. 13 is a detail view along the line 13-13 of FIG. 11.
Figure 14:
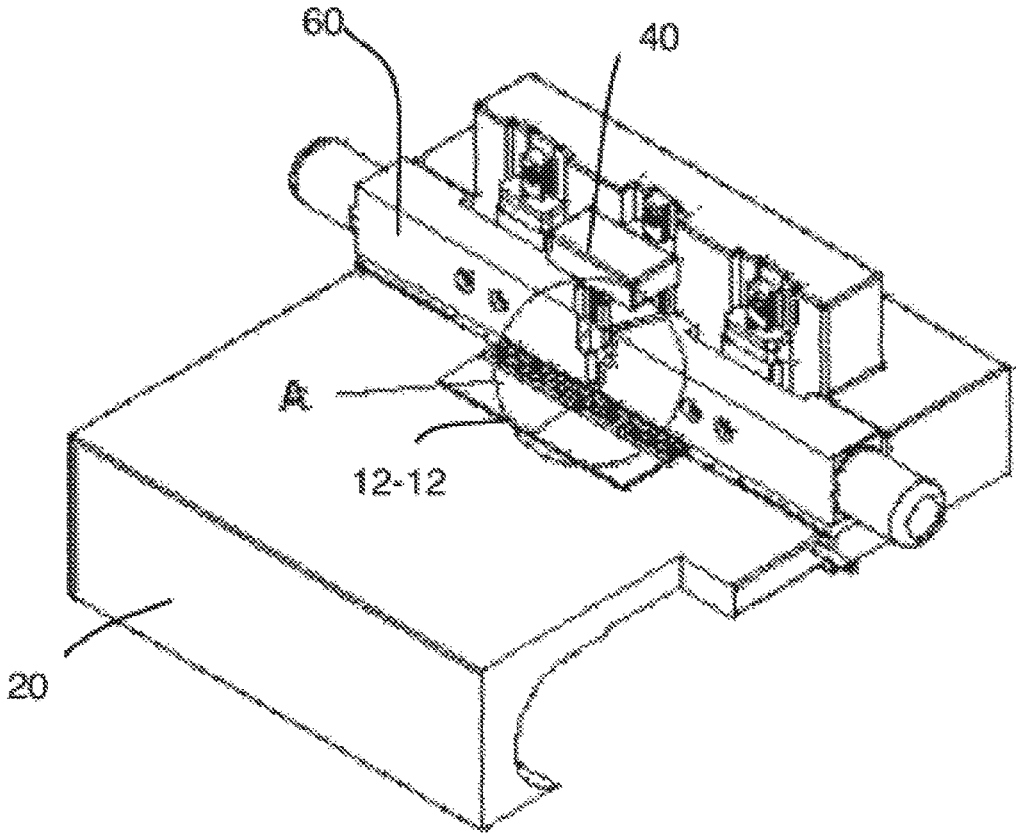
FIG. 14 is a partial offset frontal view of the embodiment of FIG. 4.
Figure 15:
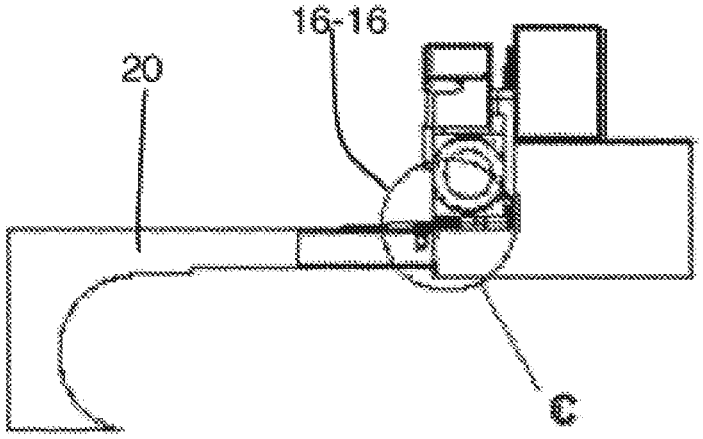
FIG. 15 is a partial side view of the embodiment of FIG. 14.
Figure 16:
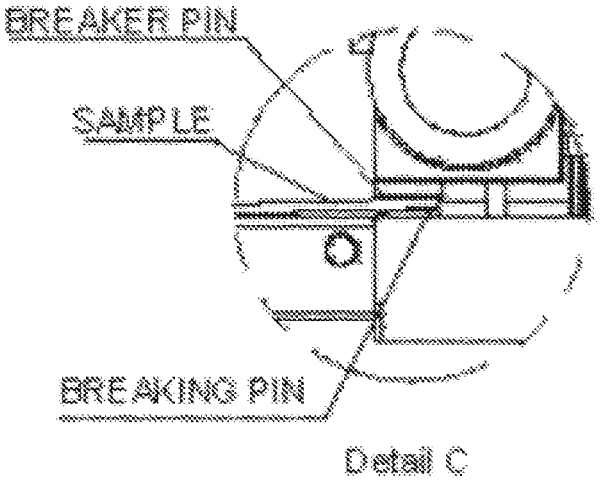
FIG. 16 is a detail view along the line "C" of FIG. 15.

The cleaving bar 60 is one long piece extending the entire width of the stage. The bar 60 thus extends from a left side, which includes a left handle 62 to the right side having a corresponding right handle 66. This bar 60 moves up and down on a vertical axis and the left handle 62 and right handle 64 cooperate to enable an operator to move the bar 60 up and down to break the sample after cleaving. The cleaving bar includes a left side breaker pin and a right side breaker pin, both located on a bottom surface of the bar and disposed on either side of a vertical axis defined between the indenter and pin 50. This way when the bar 60 is in the down position, the left pin 70 and right pin 72 pushes evenly against the sample. The pins 70 and 72 move vertically with the breaker bar 60 (See detail of FIG. 13, for example).

Thus, after the indentation or scribe is made on the top of the sample (or substrate or silicon) by the diamond knife or indenter by pushing lever 44 (also called knife holder) or using the precision knob 80, the indenter is retracted upward out of the way (the indenter and lever 44 also only move up and down on a vertical axis). Then, the breaker bar 60 is pushed downward by means of the left and right handles 62 64, which causes the pins 70 and 72 to apply a downward force on the top surface of the sample. This force is resisted by the pin 50, which contacts the bottom surface of the sample. This bottom pin 50 aligns along the same vertical axis as the indentation on the top of the sample—thus, the indenter, the indentation and the pin 50 all lie in the same line albeit at different heights on that common vertical axis—and the indenter is operable up and down whereas the pin 50 is stationary. Because the top surface of the sample has an indentation, the downward force transmitted through breaker pins 70 and 72, and resisted by pin 50, concentrates at the indentation and the sample is cleanly cleaved at the indentation.

A precision knob 80 positions above the indenter 40. The precision knob includes a threaded rod to enable precision adjustment of the indenter 40 relative to the stage 20, or more particularly a sample Son the stage. With the breaker, or cleaving bar down, the operator turns the indenter drive precision knob 80 clockwise to push the indenter to touch the top of the sample, then by turning the knob 80 as needed the operator can feel pressure of the indenter and scribe and an indentation is made on the sample. This enables a more accurate and repeatable cleaving operation as the knob can be controlled in a precise manner whereby a vertical distance traveled can be translated into "turns of the knob" in an instruction manual for the operation.

To aid retention of the sample Son the stage 20, a plurality of suction holes 86 are in fluid connection to a vacuum system whereby activation of a vacuum on switch draws suction through the holes 86 to more securely fix the sample temporarily to the stage. Although not depicted in the appended drawings, the device 10, accordingly, includes a vacuum pump, power source, controller, and related components as would be readily understood in the art.

Ascribe portion of the system includes a scale 90 on the breaker, or cleaving bar 60. This enables an operator to make a more repeatable visual positioning of a sample on the stage and assists in placing the indent line and scribe line on the sample. The scribe portion of the device 10 also includes a scribe guide (or holder) 92 that lies in the x-y plane defined by the stage 20 and extends perpendicular to the breaker, or cleaving bar. The guide 92 is guided on the stage by a guide slot 94, which lies below the top surface of the stage 22 and arranges generally parallel to the breaker 60. A guide adjuster 96 enables the scribe guide 92 to be removed from the device.

Also included in this embodiment, a pair of guide rods 98—one on the left side of the breaker and one on the right side. The guide rods include bushings to better align the breaker 60 along a vertical axis. The guide rods are used in place of the sliders, as described in the second embodiment, below. The guide rods provide a more stable alignment of the breaker 60 and have less degrees of freedom compared to the sliders of the second embodiment.

In a second preferred embodiment, as FIGS. 4-16 illustrate, the adjusting knob 80 of the first preferred embodiment is omitted to provide a more cost competitive version of the contemplated embodiment. Accordingly, the device 10 also includes a stage 20 disposed on the housing body 12, the stage having a substantially flat top 22 and a means for adjusting horizontally in the x-direction with sub-micron precision, and a knob 24 rotatably coupled to the means for adjusting the stage.

The device 10 includes a housing body 12 comprising an rear upright member 14 arranged on a lower frame 16 at about a right angle, the rear upright member including a first track 32, a second track 34, and a third track 36 wherein each track is substantially coplanar and extending vertically along a front face 30 of the rear upright member.

The device 10 further includes a lever comprising 40 a slide member 42 slideably inserted in the first track 32, the lever further including a handle 44 and a retraction spring, which is adapted to hold the slide at a top position in the first track and the handle member is operable to move the lever vertically downward, the lever further carrying an indenter 46 in a tip holder, the indenter having a diamond tip 48 at a lower, leading edge. Although a 90-degree dent is described here this "scribe" could be made at various angles between about 45-135 (+/−45) degrees. A derivative of the current embodiment could be implemented with this angle adjustment to improve positioning accuracy and minimize the contact area between the sample and the diamond tip.

The device 10 also includes a breaking pin 50 mounted on the housing body 12 to arrange under the lever 40.

Figure 4:
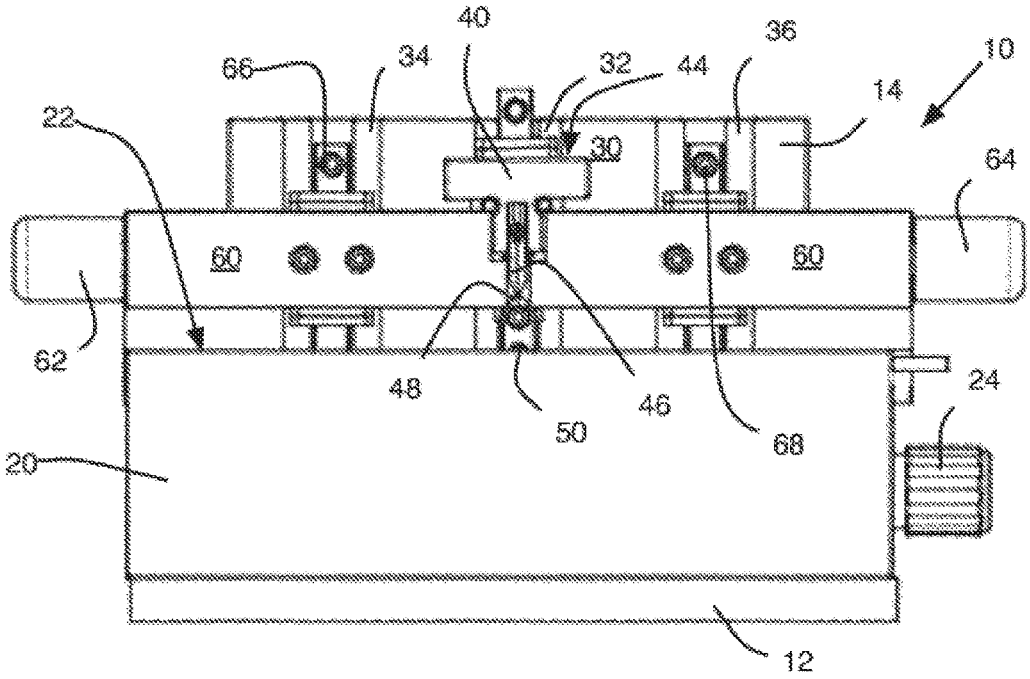
FIG. 4 is a front view of a second preferred embodiment of the present invention.
Figure 5:
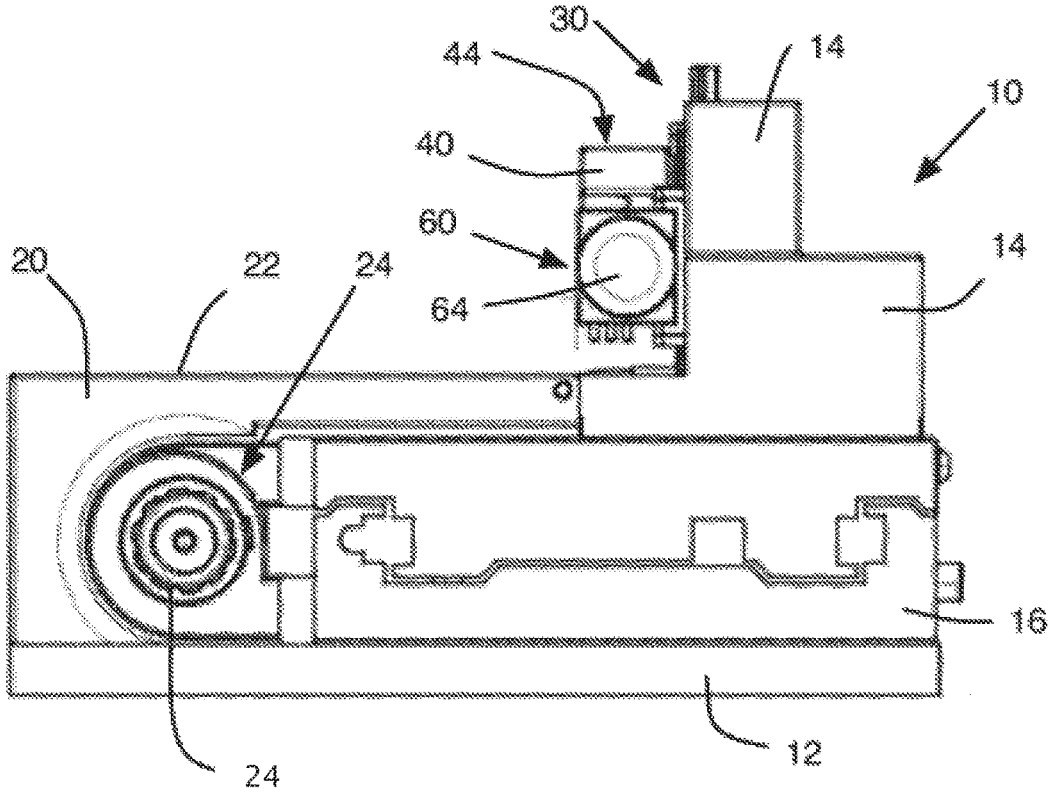
FIG. 5 is a right side view of the embodiment of FIG. 4.
Figure 6:
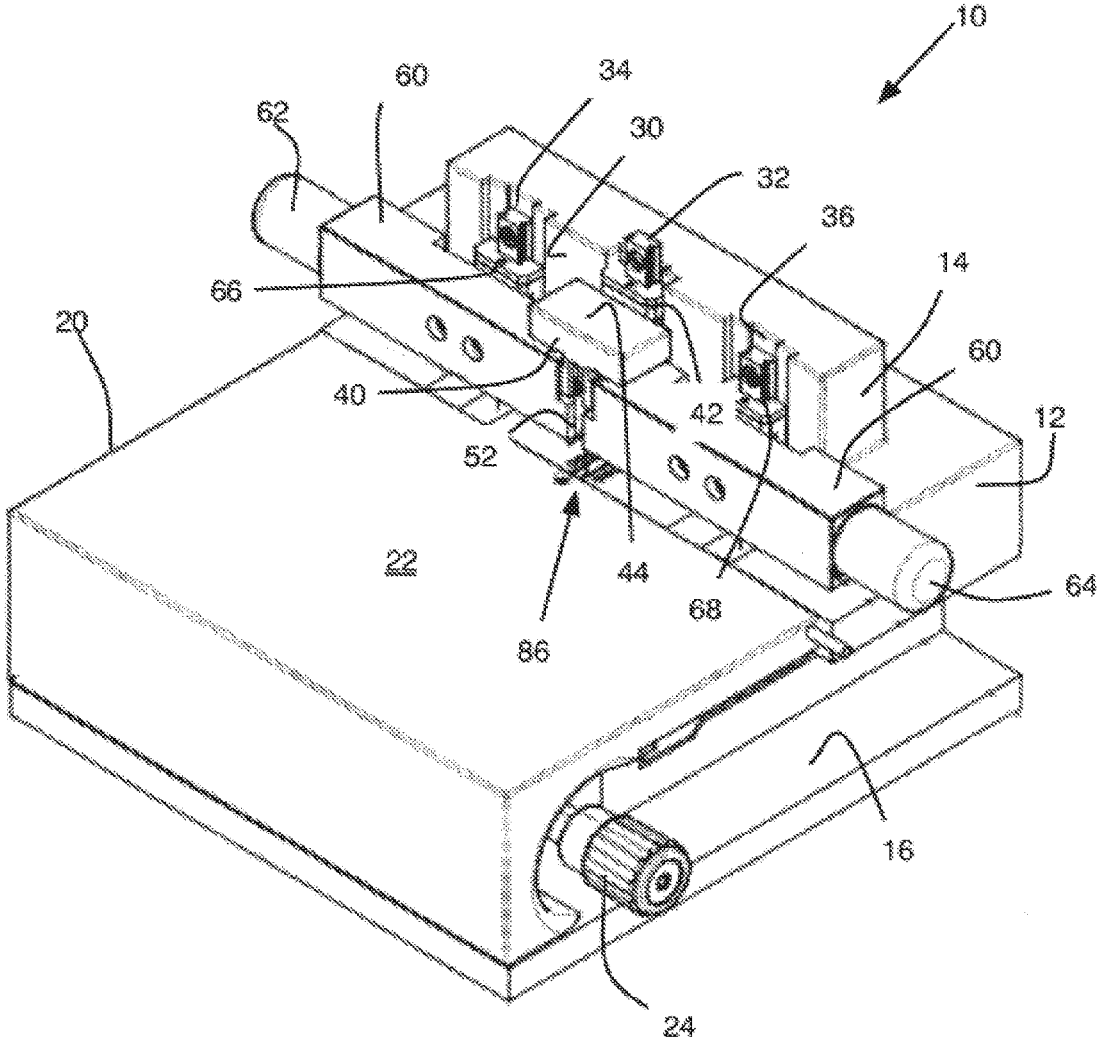
FIG. 6 is an offset frontal view of the embodiment of FIG. 4.
Figure 7:
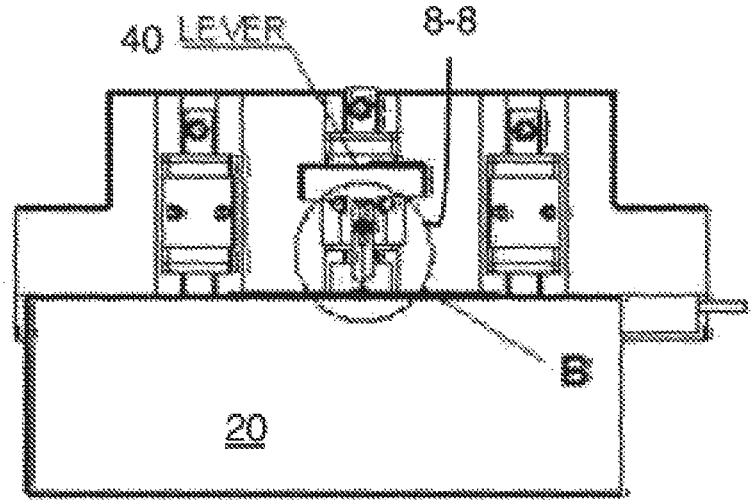
FIG. 7 is a partial front view of the embodiment of FIG. 4.
Figure 8:
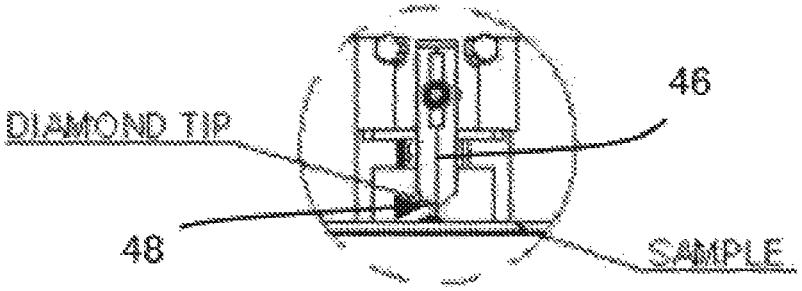
FIG. 8 is a detail view of the embodiment of FIG. 7 along the line 8-8.
Figure 9:
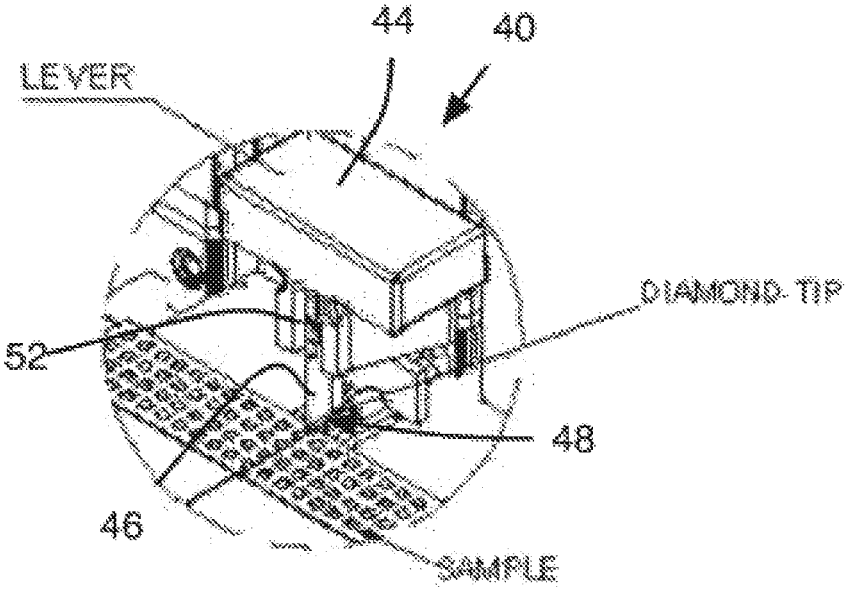
FIG. 9 is a detail view of the embodiment of FIG. 10 along the line 9-9.
Figure 10:
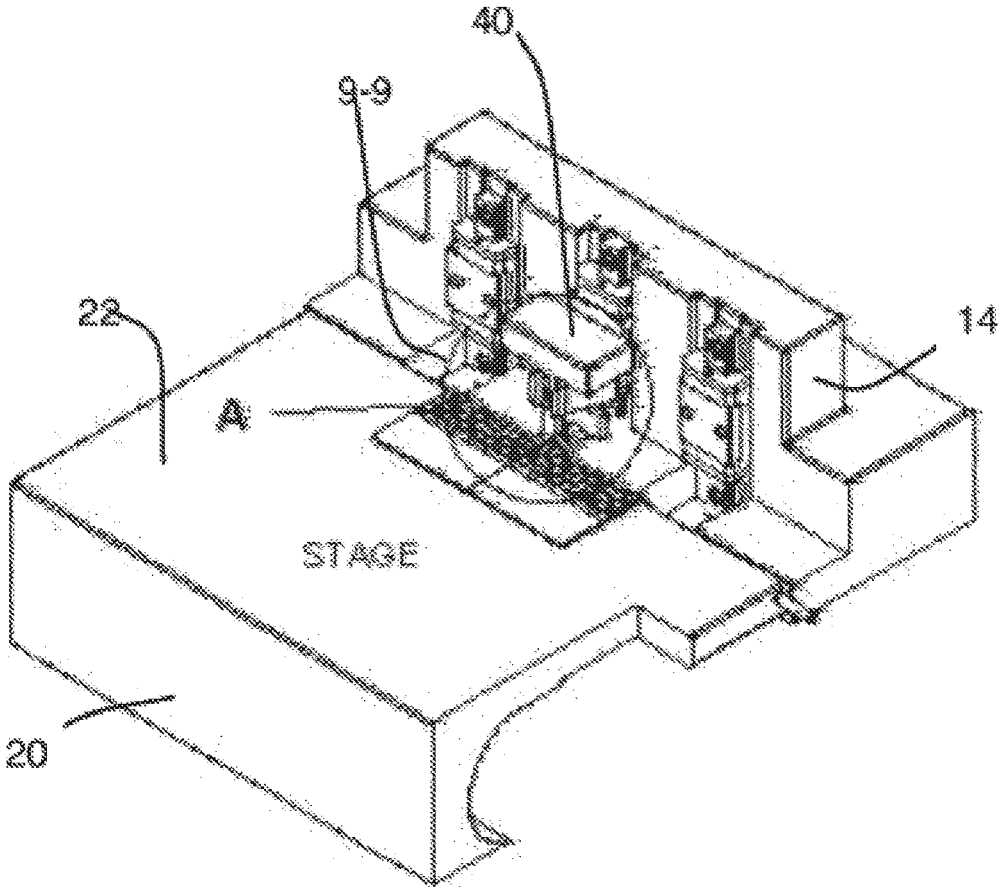
FIG. 10 is an frontal view of the embodiment of FIG. 4.
Figure 11:
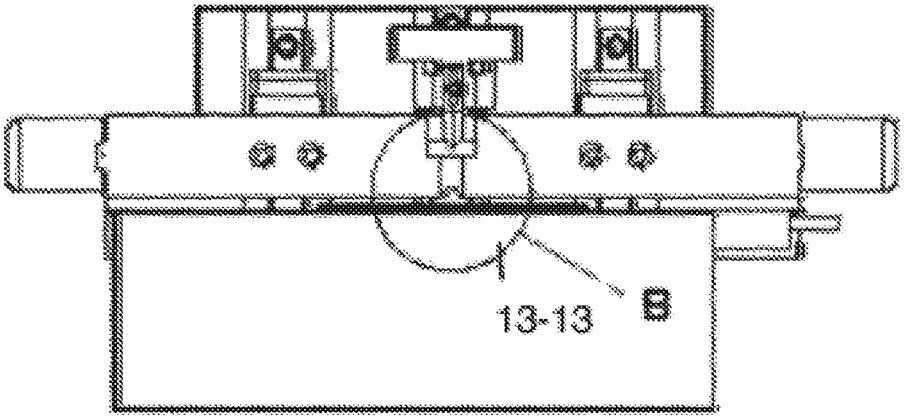
FIG. 11 is a partial front view of the embodiment of FIG. 4.
Figure 12:
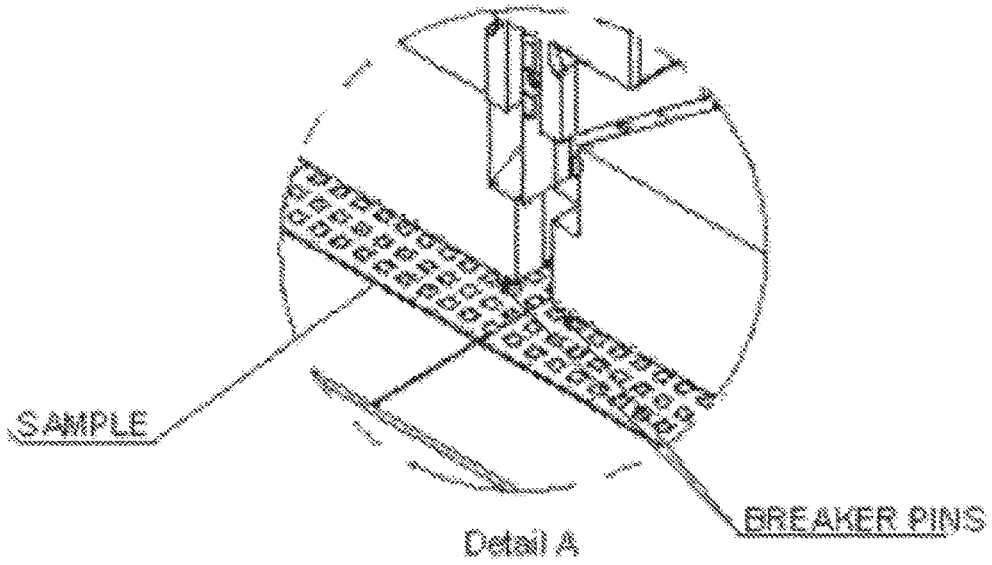
FIG. 12 is a detail view along the line 12-12 of the embodiment of FIG. 14.

This second embodiment as depicted in FIGS. 4-6, for example, includes a breaker assembly 60 disposed on the rear upright member 14. The breaker assembly is one solid bar having a left side 62 slideably inserted in the second track 34 and a right side 64 slideably inserted in the third track 36 and a center portion inserted in a center track. These three tracks cooperate to enable the bar 60 to move only in the up and down direction.

As in the first embodiment, the breaker 60 includes a left and right breaker pin 70 and 72 on its bottom surface, and these pins operate as described in the first embodiment.

It will be appreciated by those skilled in the art that any of the sub-components of the first and second embodiments can be combined with each other and still lie within the scope and spirit of the contemplated invention.

Figure 19:
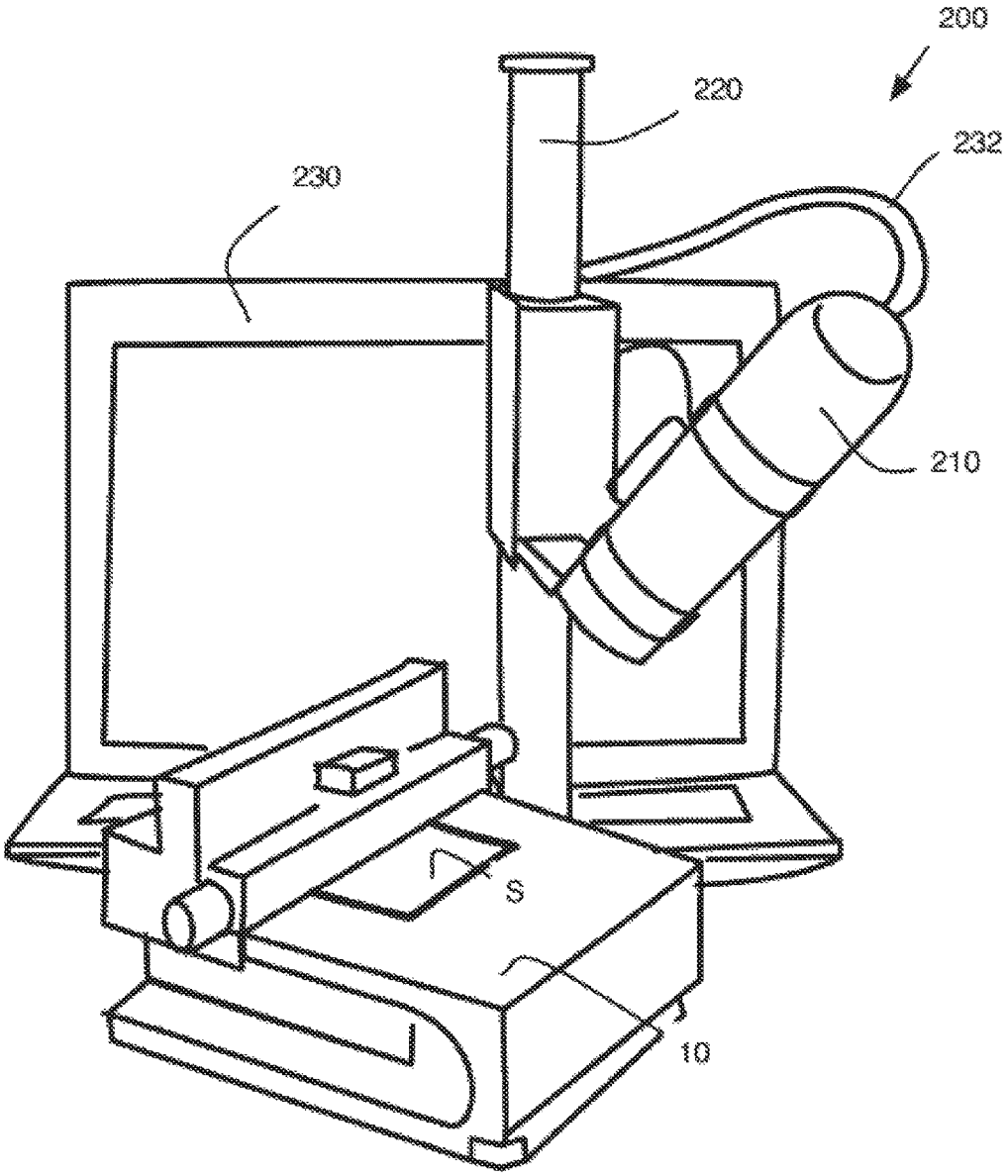
FIG. 19 is a front view of a third preferred embodiment illustrating a camera system disposed on the cleaving.

In a third preferred embodiment, as FIG. 19 shows, a camera system 200 attaches to the device 10 (as previously described in either the first or second preferred embodiments). The camera system 200 includes a camera 210 mounted to a camera fixture 220 that allows for vertical positioning of the camera 210 and movement 360-degrees around this vertical axis and about 360 degrees rotation parallel to this axis so that the camera may be positioned to image the sample S on the stage 20 of the device.

The camera 210 is in data communication with a computer 230 by means of a cable 232 or wirelessly using standard protocols such as Bluetooth or WIFI, for example. The computer includes a software program that projects a virtual line over the image of the sample on the screen. This line corresponds to the axis of the diamond indenter 50 of the device 10 to better enable precision cleaving of the sample S.

The camera system of the third preferred embodiment would work equally well in conjunction with the first and/or second preferred embodiments. For brevity, the camera system 200 is described with reference to the second preferred embodiment, however those skilled in the art will appreciate its applicability to any of the preferred embodiments and the camera system can be readily modified and adapted for use with any of the embodiments without undue experimentation.

The computer 230 can be any Mac or PC or unix-based system as would be well-appreciated by those of ordinary skill in the art.

The base for camera stand also serves as base for the device 10, this is not necessary for the system to operate but is included as a convenience.

In a fourth preferred embodiment, the present invention contemplates a method of cleaving a substrate using any of the first three previously discussed preferred embodiments. The method or methods of the present invention contemplate use of any of the devices of any of the embodiments. Again, for brevity, a method of use is described herein with reference to one of the preferred embodiments and those skilled in the art will understand that additional steps could be augmented without detracting from the scope of the invention. Conversely, and equally applicable, elements could be eliminated or combined and still not detract from the scope and spirit of the invention.

Figure 17:
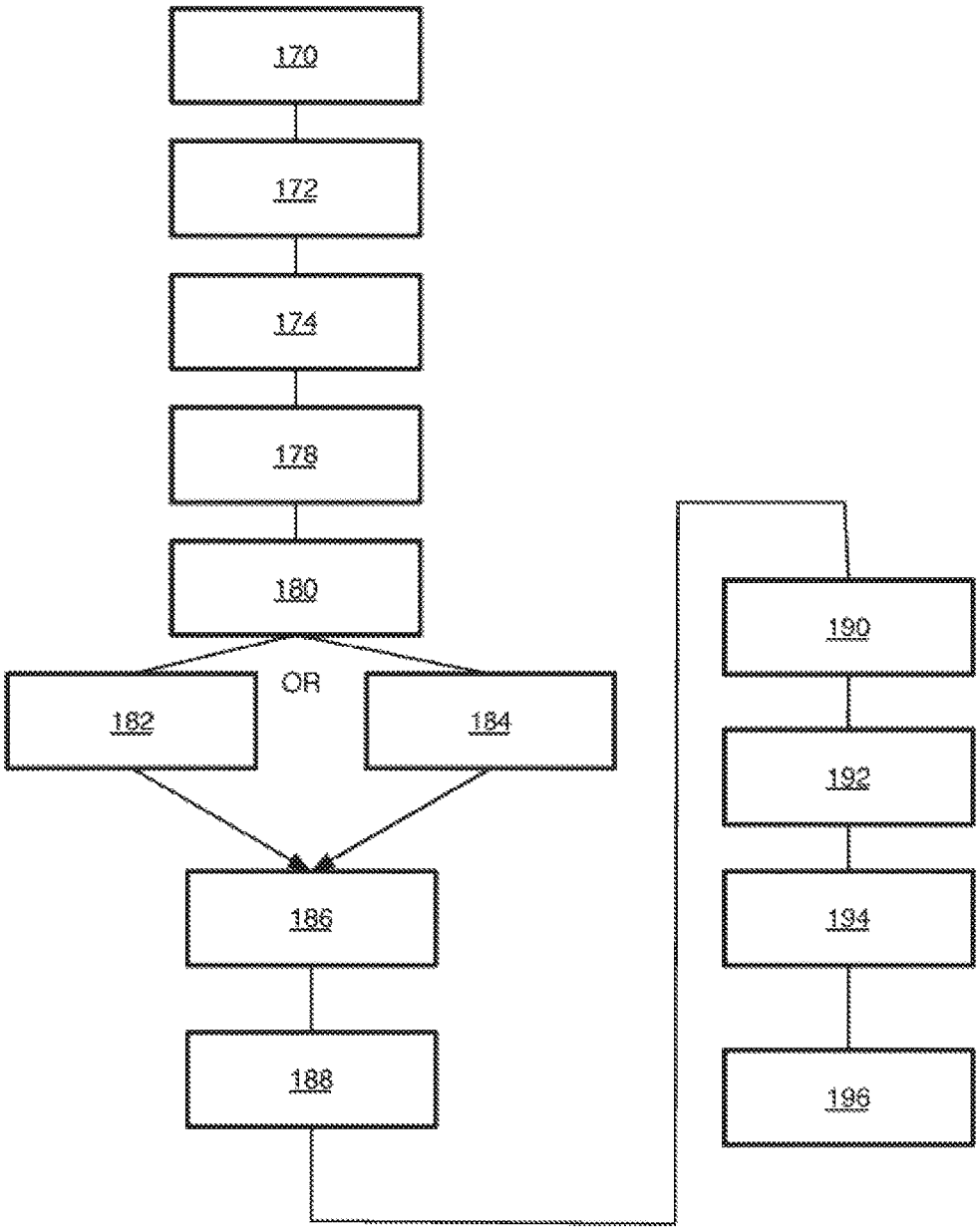
FIG. 17 is a flow chart of a method according to a fourth preferred embodiment of the present invention.
Figure 18:
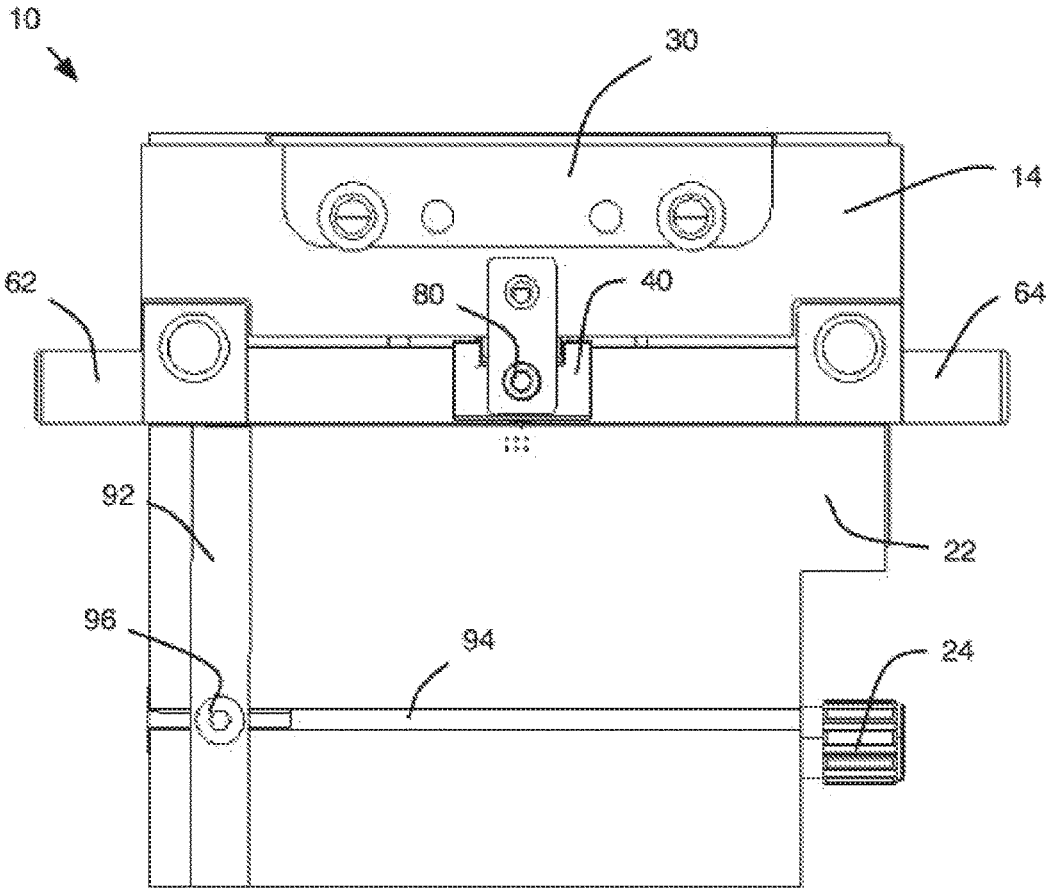
FIG. 18 is a top view of the embodiment of FIG. 1.

In this embodiment, as FIG. 17 illustrates, one step is to clean the stage (block 170), especially under the cleaving bar as dust and other debris on the stage can damage the cleave, result in an inaccurate cleave, damage the mechanism, or otherwise waste or make inefficient the process of cleaving a substrate. One possible way to clean the stage is with a fine bristle brush, another way is to blow compressed air across the surface, for example.

Once the stage is clean, a substrate (sample) is positioned on the stage (block 172) (the stage is aligned in the z-plane, which is the horizontal plane). The cleaving bar is extended to its full down position 174 and the sample is set on the stage with its front edge flush and adjacent to the cleaving bar (block 174)—this positions the sample on the stage and allows for x and y movement on the stage. Ideally, the substrate, such as a wafer piece, is placed against the cleaving bar with a straight and true edge flush against the cleaving bar, as the accuracy of the cleave operation is determined by the quality of the first edge. Next, a manual (or coarse) positioning of the sample is adjusted by putting the area of interest "AOI", and the knife-edge is used approximate the location of sample along the x-axis in the z-plane.

Then, the vacuum pump is powered on while the sample is held in place (block 176). Next, for systems that do not include a camera system, the spring-loaded indenter 40 is pushed down by hand until the indenter is just above the top surface of the sample, but not touching the surface (block 178). The stage can now be positioned in the x-direction by turning the stage drive knob 24 to align the indenter apex with the desired location of the cleave (block 180). For systems that include a camera system, a more precise alignment of the cleave can be positioned by using a line drawing feature of the software associated with the camera system (as described above) (block 182). The line drawing feature superimposes a visual line on a monitor with a live image of the sample on the stage in focus. Again, the stage drive knob provides precise x-direction alignment of the virtual line relative to the sample. In yet another embodiment, a laser beam can be projected on the sample corresponding to the location of the indenter apex. This laser beam could work with the camera system (block 184), but one advantage of the laser is that the camera is not required to visualize where the cleave would lie on the sample. However, one advantage of the camera is the ability to magnify the sample and therefore allow a more precise visual and manual aligning of the sample relative to the indenter apex.

With the sample in the desired position, the indenter positions over the sample. Then, continued pressure on the breaker bar results in the indenter pushing into the sample (block 186). If the device includes an indenter drive knob, this knob can be turned until the indenter is touching the top of the sample and the sample is now pinched between the indenter and the breaker, or cleaving bar. Then, a twist of the knob clockwise corresponding to the needed movement for downward travel creates sufficient pressure on the sample to enable smooth operation of the scribe (block 188). If this indenter drive knob 80 is not included in the system, then the operator uses hand pressure on the indenter bar while manipulating the scribe.

Finally, the breaker, or cleaving bar is lifted, the vacuum is turned of and the sample is re-positioned for cleaving (block 190). With the cleaving bar lifted, the sample is slid under the cleaving bar until it abuts against the back vertical wall (back wall) (block 192). The indentation line that is physically on the sample as a result of the scribe line just described is visually aligned to a reference mark on the back wall. The scribe is positioned on the breaker pin hill. For systems with a camera system, accuracy can be verified by viewing the monitor.

Next, the breaker bar is held by the operator at both ends, with one hand on the left breaker knob and the opposite hand on the right breaker knob. Downward pressure on the knobs causes the sample to break at the scribe line (block 194). Next, lift up the breaker knobs and remove the cleaved sample from the stage (block 196).

The device 10 of the present invention, in all of its various embodiments, is well suited for cleaving substrates of most known diameters from about 4-inches to about 12-inch diameters, but this should not be limiting. However, other sized substrates would work equally well with little or no modification to the components of this invention. And, one contemplated method includes steps including placing a sample on the stage; adjusting the y direction of the sample manually; adjusting the x-direction of the sample by using the knob; scoring a break line on a top portion of the sample by moving the lever downward causing the diamond tip indenter to imprint on the substrate; releasing the lever; pushing on the left and right breaker handles simultaneously causing the breaker assembly to move downward, causing the left and right breaker pins to press against the sample; contacting the sample on an underside by the breaking pin; and breaking the sample along the score by means of the breaking pin and left and right breaker pins.

FIGS. 20-24 illustrate a preferred method of the present invention. This method is a method of cleaving a sample. The method includes creating an indentation on atop surface of the sample by applying a downward force along a vertical axis. The vertical axis arranges perpendicular to the top surface of the sample, and the downward force can align with the vertical axis or be offset plus or minus 45-degrees. Further, the method includes providing a breaking pin and arranging the breaking pin under the sample, coincident to a bottom surface of the sample at a position that is directly opposite from the indentation. And, the method includes applying a downward force on the sample wherein the downward force comprises a left-side downward force and right-side downward force, each left-side and right-side downward force arranged on opposite sides of the indentation on the top surface.

Figure 20:
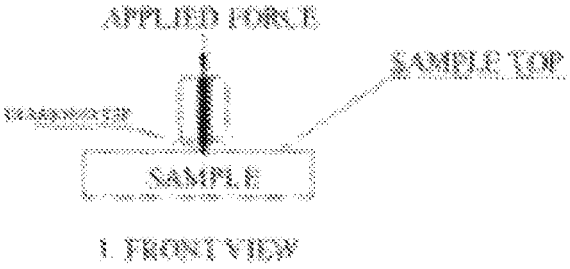
FIG. 20 illustrates one step of a method according to a preferred embodiment of the present invention.
Figure 21:
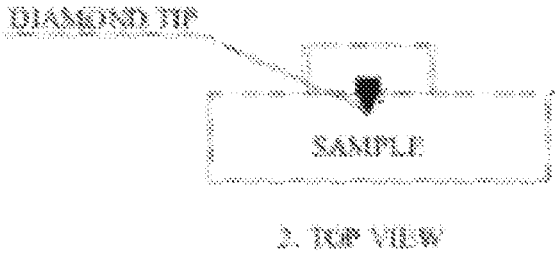
FIG. 21 illustrates another step of the method of FIG. 20.
Figure 22:
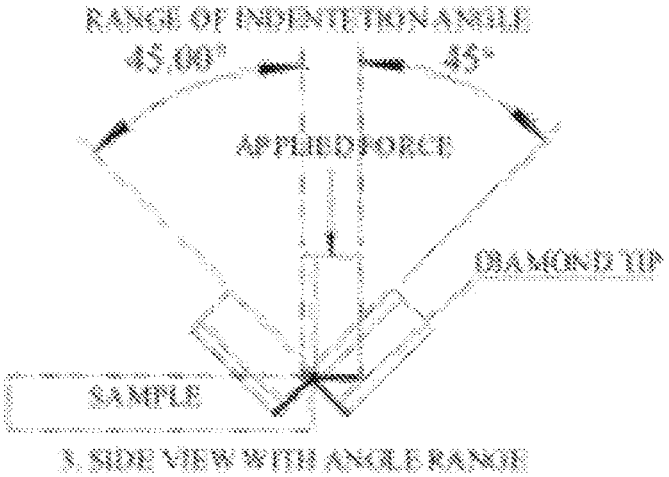
FIG. 22 illustrates another step of the method of FIG. 20.
Figure 23:
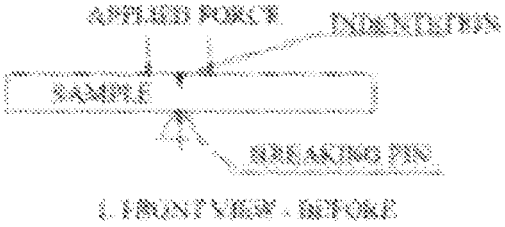
FIG. 23 illustrates a sample being cleaved by the method of FIGS. 20-22 at first point in time.
Figure 24:
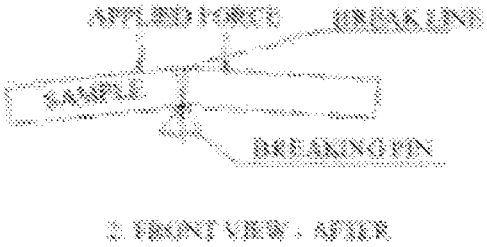
FIG. 24 illustrates the sample of FIG. 23 at a second point in time.

More specifically, FIGS. 20-22 depict this preferred scribing (or indenting) method, and FIGS. 23-24 depict the breaking (or cleaving) method. From FIGS. 20-24, it will be appreciated that the two steps work together to provide a complete and improved cleaving process. Accordingly, FIGS. 20-21 shows an indentation being created on the top surface of a sample. And FIG. 22 illustrates that this indentation can be created at 90 degrees +/−45 degrees tilt from the vertical axis. Then, with the indentation complete from FIGS. 20-23, as appropriate, the cleaving (or breaking) process can begin. FIGS. 23 and 24 show a downward directed applied force pushing against the top surface of the sample. The downward force is split to the left and right sides of the indentation. And, an opposite, resisting force is applied by the breaking pin, which touches the bottom surface of the sample. As the downward force increases, and because of the indentation on the top surface, the sample yields at the indentation and a clean break or cleave is obtained. It will be appreciated from these FIGS. that the indentation and bottom breaking pin are aligned in a common vertical axis.

Further, this method contemplates providing a knife or indenter having a diamond tip and enabling the indenter to adjust up to +/−45-degrees from perpendicular, arranging the indenter on the vertical axis and enabling the indenter to be operable from a first retracted position to a second extended position wherein the extended position causes the indenter to contact the top surface of the sample.

Another contemplated method includes either cleaving or indenting or both on one machine or on two separate machines.

Another contemplated system includes a first machine for indenting a sample and a second machine for cleaving the sample. The operations of cleaving and indenting can then be done independently and one operation would not need the other operation. For example, a machine could indent a sample, but the cleaving of that sample could be done by hand, or by another traditional cleaving device known in the art.

Another contemplated system holds the top left and right pins stationary and makes the bottom breaking pin move upward towards the left and right pins. One example is that the entire stage could be operable to move from a retracted, down position to a second upward position that causes the indenter and/or left and right pins to contact the sample, and to continue moving to either indent the sample or to cleave the sample, or both. What is critical is the relative movement of the breaking pin in relation to the left and right pins, which are positioned on either side of the indentation. However, how the indentation was made, or which pins move, and which direction the pins move, is not as critical as the relative motion between these elements.

Another contemplated method includes the steps of providing a cleaving device comprising a stage horizontally disposed on a housing body, the stage having a substantially flat top and a means for adjusting horizontally in the x-direction with sub-micron precision; an indenter slideably arranged to be operable along a vertical axis arranged perpendicular to the top of the stage, the indenter slideably mounted to the housing body, the indenter comprising an indenter comprising a diamond tip, the indenter disposed to operate from a first retracted position to a second extended position along the vertical plane; a breaking pin mounted on the housing body to arrange under the indenter; and a breaker, or cleaving bar disposed on the housing body and being operable along a vertical axis from a first retracted position to a second contacting position, the breaker, or cleaving bar further comprising a left side breaker pin arranged on a bottom surface of the breaker, or cleaving bar and a right side breaker pin on the bottom surface wherein the left and right side pins are disposed on opposite sides of the breaker bar relative to the vertical axis; placing the sample on the stage; creating an indentation on a top surface of the sample by applying a downward force along a vertical axis, the axis arranging perpendicularly to the top surface of the sample; applying a downward force on the sample wherein the downward force comprises a left-side downward force and right-side downward force, each left-side and right-side downward force arranged on opposite sides of the indentation on the top surface.

This method also includes pushing on the left and right breaker handles simultaneously causing the breaker assembly to move downward, causing the left and right breaker pins to press against the sample; contacting the sample on an underside by the breaking pin; and breaking the sample along the indentation by means of the breaking pin and left and right breaker pins.

This method further includes providing a camera system comprising a camera and software resident on a computer, the computer in signal communication with the camera the software adapted to display on the computer an image; and using the camera system to align the sample.

Figure 25:
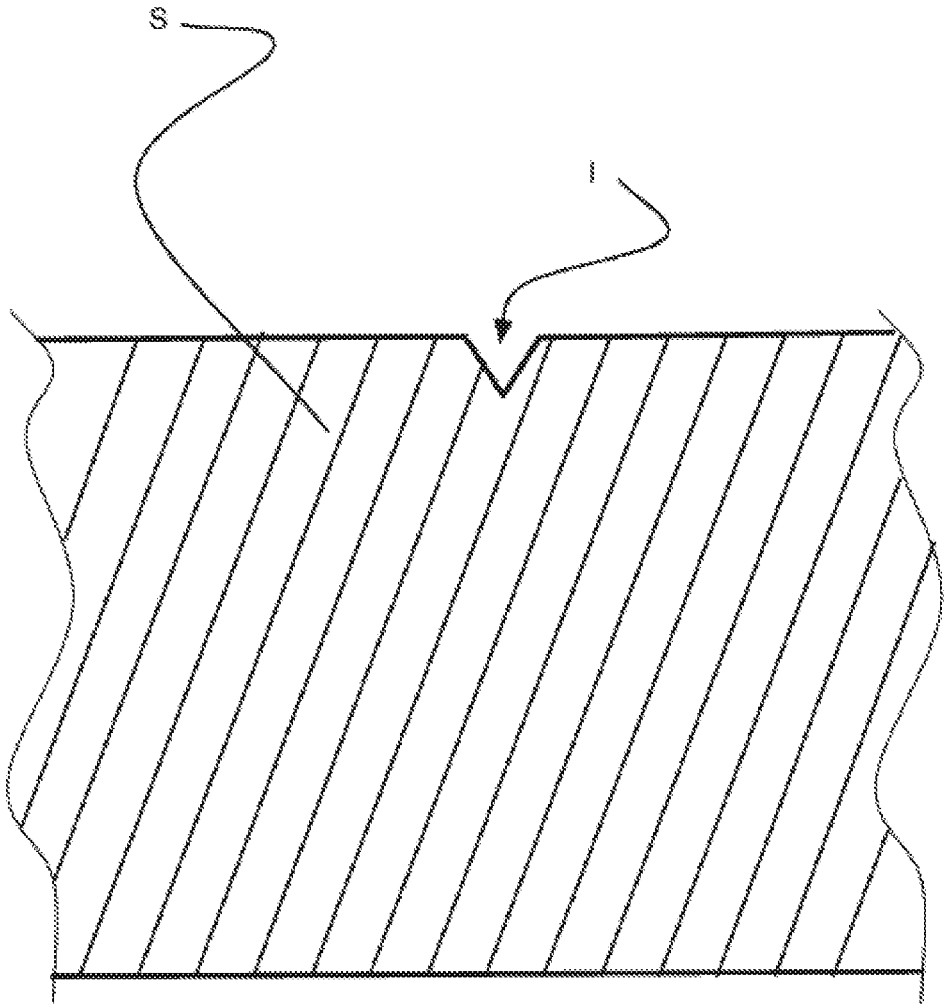
FIG. 25 is a cross sectional view of a portion of a sample S having an Indentation I according to at least one embodiment of the present invention.

FIG. 25 is a cross sectional view of a portion of a sample S having an Indentation I according to at least one embodiment of the present invention.

Figure 26:
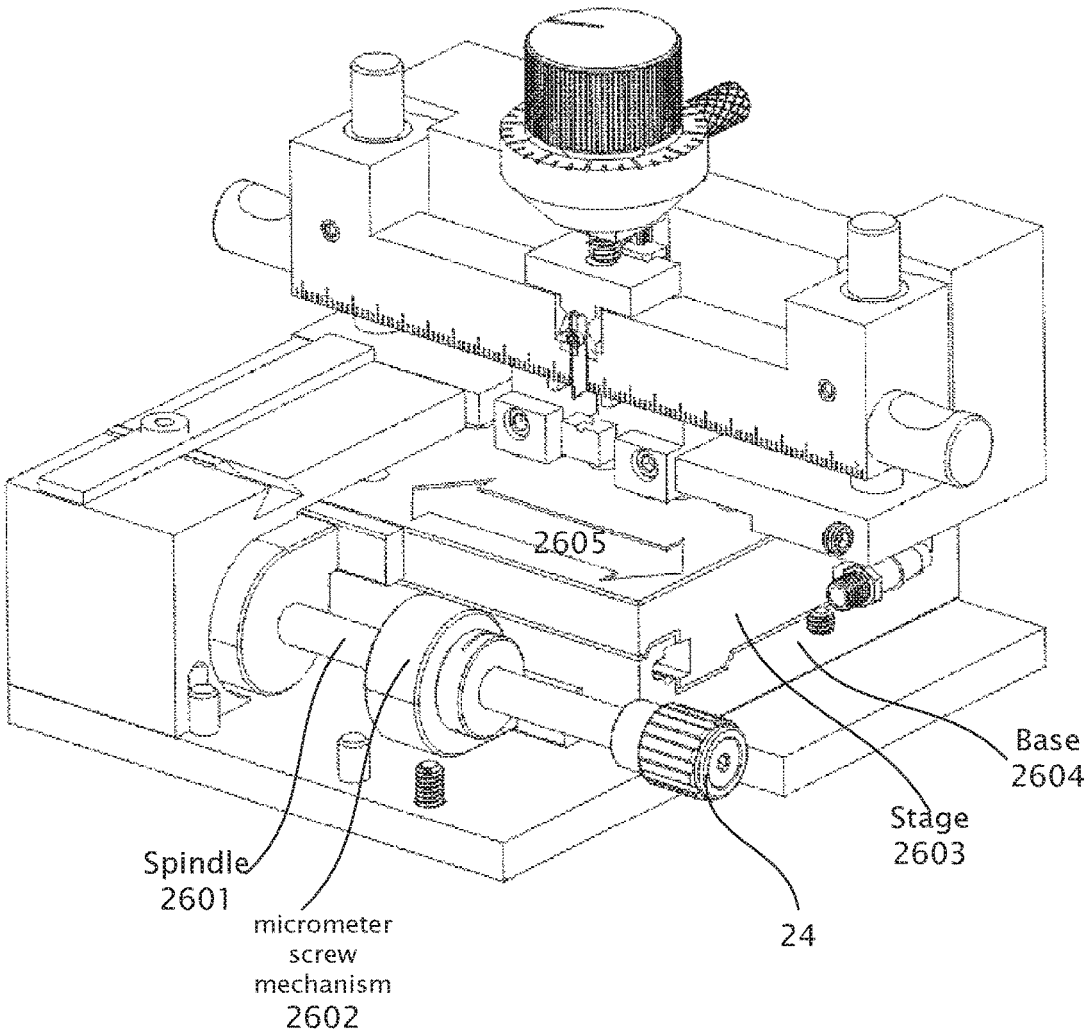
FIG. 26 is a cutaway view showing the exemplary Newport stage incorporated into the invention.

FIG. 26 is a cutaway view showing the exemplary Newport stage incorporated into the invention.

Figure 27:
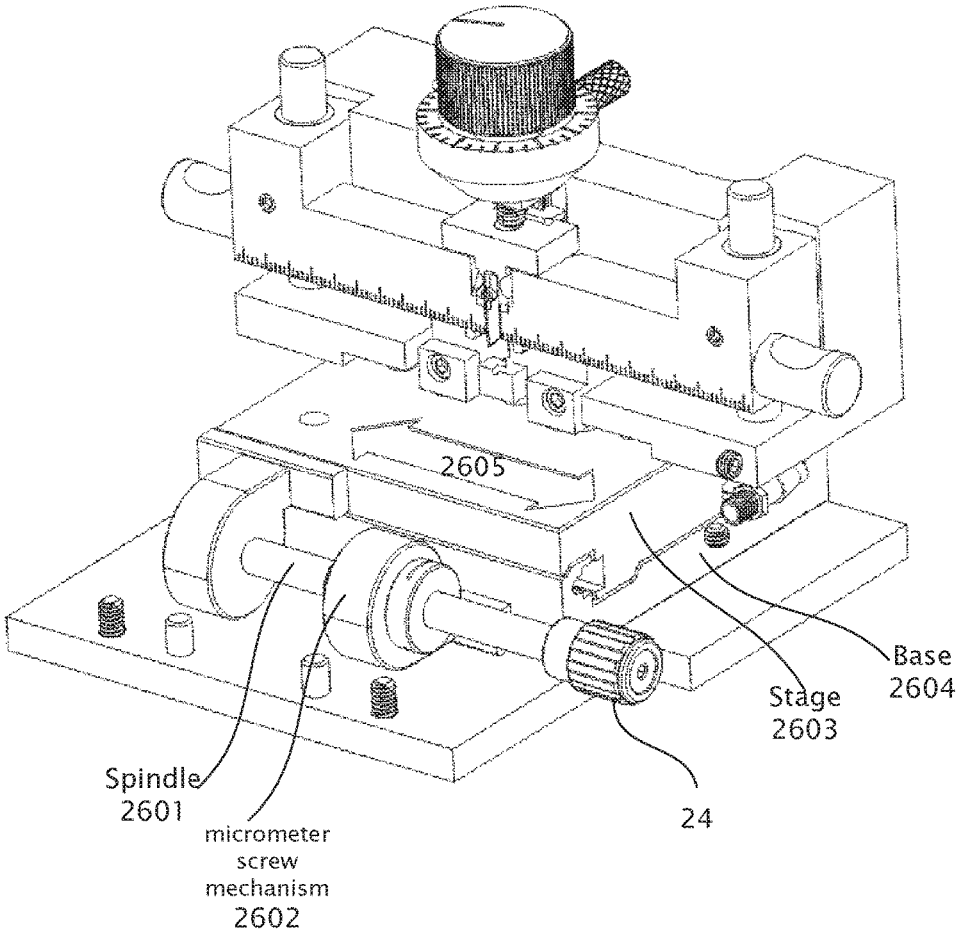
FIG. 27 shows the tool with the exemplary Newport stage exposed as disposed in the example.

FIG. 27 shows the tool with the exemplary Newport stage exposed as disposed in the example.

FIGS. 26-27 show an exemplary Newport stage coupled to the knob 24 and the direction o motion. The entire assembly shown with an indenter and pin assembly moves in the X direction 2605 while the sample plate holding the sample stays fixed. Typically the adjustment in the X direction is controlled by a micrometer screw mechanism 2602 coupled to a base assembly 2604 which is slidably coupled to a movable platform assembly 2603. The micrometer mechanism 2602 has a body coupled to the base or platform assembly 2604, and the slidably extensible rod or spindle 2601 is controlled by the micrometer mechanism 2602. The spindle 2601 is coupled to the stage 2603, whose movement is controlled by the screw mechanism 2602 to which is coupled. Or equivalently the screw mechanism may be coupled to the stage, and the spindle to the base. The spindle may be moved by turning the ratchet knob or thimble 24. FIG. 26 is a cutaway the second shows the tool with the stage exposed. The stage in general terms may be a commercially available High-Performance Low-Profile Ball Bearing Linear Stage such as the exemplary model 423 produced by the Newport corporation of Irvine, Calif., a subsidiary of MKS Instruments or its equivalent.

The exemplary stage may include a typically 3 in. square platform utilizing precision ball bearing construction—typically hardened balls rolling between opposing pairs of hardened and polished stainless steel rods providing better than 200 micro-radian angular deviation, for example. For stability, repeatability, and smooth motion, actuators may bear upon a hardened carbide insert. Springs may provide preloading against the actuator tip to eliminate backlash. Although the stage is typically capable of traveling a full 1 in. (25.4 mm) with an SM-25 micrometer drive, the actuator mounting blocks can be relocated to accommodate 0.5 in. (12.7 mm) drives like the SM-13. This stage can also be reconfigured into a left-handed version with the micrometer on the opposite side. A non-influencing lock (also reversible for left-handed configuration) provides positive stable positioning and guards against inadvertent adjustments.

Those skilled in the art will realize that the process sequences described above may be equivalently performed in any order to achieve a desired result. Also, sub-processes may typically be omitted as desired without taking away from the overall functionality of the processes described above.

The invention claimed is:

1. A method of cleaving a sample comprising:

creating an indentation on the top surface of the sample by extending an indenter arranged on a vertical axis toward the top surface of the sample whereby a diamond tip of the indenter causes a defect in the sample and retracting the indenter along the vertical axis after the indentation is made on the sample;

adjusting a depth of the indenter along the vertical axis to provide a user variable downward force of the tip on the sample;

providing a breaking pin and arranging the breaking pin under the sample coincident to a bottom surface of the sample at a position that is directly opposite from the indentation on the top surface;

selecting a cleaving bar movable up and down parallel to the vertical axis, the cleaving bar comprising a first pin and a second pin and contacting with the first pin the top surface of the sample on one side of the indentation and contacting the second pin against the top surface of the sample on an opposite side of the indentation and whereby the cleaving bar moves independent of the indenter; and moving the first and second pins toward the breaking pin.

2. The method of cleaving a sample of claim 1, wherein the vertical axis is perpendicular to the top surface of the sample.

3. The method of cleaving a sample of claim 2, further comprising:

wherein moving the first and second pins toward the breaking pin further includes:

selecting a cleaving bar a including long piece extending substantially the entire width of the stage, the cleaving bar further a left handle disposed on a left side and a right handle disposed an a right side, the cleaving bar further includes a left side breaker pin and a right side breaker pin, both breaker pins located on a bottom surface of the cleaving bar and disposed on either side of the vertical axis;

operating the cleaving bar down along the vertical axis using the left and right handles;

using the cleaving bar, pushing down simultaneously on both the left pin and right pin, thus pushing evenly the sample, the pins moving vertically with the motion of the cleaving bar;

arranging the indenter and the breaking pin along the vertical axis;

retracting the indenter away from the sample along the vertical axis; and disposing the breaker pin on the device whereby the breaker pin does not move along the vertical axis and is thereby held stationary with relationship to the cleaving bar that moves in parallel to the vertical axis.

4. The method of cleaving a sample of claim 1, further comprising:

wherein an operator moving the cleaving bar having first and second pins toward the breaking pin disposed in a stage further includes moving the first and second pins in a downward direction by moving the cleaving bar downward and holding the breaking pin stationary.

5. The method of cleaving a sample of claim 1, wherein the indenter is arranged within a range of plus or minus 45 degrees from the vertical axis.

6. The method of cleaving a sample of claim 2, further comprising:

providing a diamond tip disposed on a distal end of the indenter and enabling the indenter to adjust up to +/−45-degrees from perpendicular, arranging the indenter on the vertical axis and enabling the indenter to be operable from a first retracted position to a second extended position wherein the extended position causes the indenter to contact the top surface of the sample.

7. A method of cleaving a sample comprising:

providing a cleaving device comprising a stage horizontally disposed on a housing body, the stage having a substantially flat top and a knob for adjusting the stage horizontally in the x-direction with sub-micron precision independent of the substantially flat top of the stage and a breaking pin mounted on the housing body adapted to arrange under the sample and a cleaving bar disposed on the housing body and being operable along a vertical axis from a first retracted position to a second contacting position, the cleaving bar further comprising a left side breaker pin arranged on a bottom surface of the cleaving bar and a right side breaker pin on the bottom surface wherein the left and right side pins are disposed on opposite sides of the cleaving bar in relationship to the vertical axis;

placing the sample on the stage;

adjusting the sample horizontally in the x-direction via the stage; and cleaving the sample using the cleaving bar.

8. The method of cleaving a sample of claim 7, in which the indenter is slideably arranged to be operable along a vertical axis arranged perpendicular to the top of the stage, the indenter slideably mounted to the housing body, the indenter comprising a diamond tip, the indenter disposed to operate from a first retracted position to a second extended position along the vertical plane.

9. The method of cleaving a sample of claim 7, further comprising:

providing a camera system coupled to a vertical mounting pole, the camera system comprising a camera, software resident on a computer, the computer in signal communication with the camera the software adapted to display on the computer an image; and imaging the sample on the stage using the camera system.

10. The method of cleaving a sample of claim 6, further comprising:

providing a left side guide post arranged on a left side of the housing; providing a right side guide post arranged on a right side of the housing; and arranging the cleaving bar over the left and right side guide post to be slidable along a vertical axis.

11. The method of cleaving a sample of claim 8, further comprising:

providing the indenter with a knob coupled to a threaded member whereby the diamond tip locates at a distal end of the threaded member and whereby rotation in a first direction of the knob causes downward movement of the indenter and rotation of the knob in an opposite direction causes retraction of the indenter; and adjusting the indenter to contact the sample on the stage.

12. The method of cleaving a sample of claim 8, further comprising:

configuring the diamond tip to be selectively adjustable +/−45 degrees from a vertical axis; and adjusting the tip +/−45 degrees in relationship to the vertical axis.

* * * * *